US007979971B2

(12) United States Patent
Noah et al.

(10) Patent No.: US 7,979,971 B2
(45) Date of Patent: Jul. 19, 2011

(54) HAND TOOL WITH AN EXTENDABLE PLUNGER

(75) Inventors: Mark P. Noah, Butler, PA (US); Glenn R. Snyder, Dayton, PA (US); Joseph Brandon Delaney, Lyndora, PA (US); Robert A. Gagliardi, Butler, PA (US); David Carl Jones, Cabot, PA (US)

(73) Assignee: Penn United Technologies, Inc., Cabot, PA (US)

( * ) Notice: Subject to any disclaimer, the term of this patent is extended or adjusted under 35 U.S.C. 154(b) by 0 days.

(21) Appl. No.: 12/754,034

(22) Filed: Apr. 5, 2010

(65) Prior Publication Data

US 2010/0186213 A1 Jul. 29, 2010

Related U.S. Application Data

(62) Division of application No. 11/745,159, filed on May 7, 2007.

(51) Int. Cl.
*B21D 39/03* (2006.01)

(52) U.S. Cl. ..... 29/428; 29/451; 254/26 E; 279/76; 279/2.1; 279/2.11

(58) Field of Classification Search ..... 254/26 E; 29/428, 451; 279/76, 2.1, 2.11, 93, 97, 2.23; 74/538; 81/20; 248/352, 354.5, 354.6, 407, 248/423; 403/109.5, 327, 379.4, 108, 109.1, 403/351, 375; 30/342
See application file for complete search history.

(56) References Cited

U.S. PATENT DOCUMENTS

| | | | | | |
|---|---|---|---|---|---|
| 540,967 | A * | 6/1895 | Eveleth | ..... | 254/26 E |
| 856,097 | A | 6/1907 | Palmer | | |
| 2,589,046 | A * | 3/1952 | Brown et al. | ..... | 254/26 E |
| 2,589,047 | A | 3/1952 | Brown et al. | | |
| 2,741,456 | A * | 4/1956 | Williams | ..... | 254/26 E |
| 4,212,559 | A * | 7/1980 | Persson | ..... | 403/348 |
| 4,998,996 | A * | 3/1991 | Belanger | ..... | 254/26 E |
| 5,441,236 | A * | 8/1995 | Kiernan | ..... | 254/26 E |
| 6,827,333 | B1 * | 12/2004 | Lutz | ..... | 254/26 E |
| 6,862,765 | B2 * | 3/2005 | Liou | ..... | 7/143 |
| 7,051,998 | B2 * | 5/2006 | Sleiman | ..... | 254/26 E |

* cited by examiner

*Primary Examiner* — David P Bryant
*Assistant Examiner* — Bayan Salone
(74) *Attorney, Agent, or Firm* — Eckert Seamans Cherin & Mellott, LLC; David C. Jenkins, Esquire; Grant E. Coffield, Esquire

(57) ABSTRACT

A hand tool having an elongated plunger assembly that is rotatably and movably disposed in a socket. The plunger assembly can be rotated between a first orientation and a second orientation as well as being moved between a first, withdrawn position and a second, extended position. The plunger assembly also has an upper notch and a lower notch on a front side and at least one generally flat lateral side. A fixed latch member extends across a portion of the socket and defines a narrow passage within the socket. The hand tool, preferably, includes a compression spring biasing the plunger assembly toward the extended position.

2 Claims, 3 Drawing Sheets

HAND TOOL WITH AN EXTENDABLE PLUNGER

CROSS REFERENCE TO RELATED APPLICATION

This application is a divisional application of U.S. Ser. No. 11/745,159, filed May 7, 2007, entitled HAND TOOL WITH AN EXTENDABLE PLUNGER.

BACKGROUND OF THE INVENTION

1. Field of the Invention

This invention relates to a hand tool having a claw and, more specifically, a hand tool having an extendable plunger disposed adjacent to the claw.

2. Background Information

Hand tools having claws include, but are not limited to, hammers, crowbars, and wrecking bars. Of these, hammers are the most common and well known and, hereinafter, it is understood that as used herein a "hammer" shall mean any hand tool having a claw. The claw, typically includes two fingers with a narrowing gap therebetween. The claw is disposed at one end of the hand tool, such as at the head of a hammer, and extends generally perpendicular to the longitudinal axis of the hand tool handle. The claw is, typically, slightly arcuate. The claw is used to pry nails and other elements away from a substrate. For example, a nail having a shaft and a head is disposed in a board. If the nail is not already loose, a user initially pries the nail out of the board using the distal tips of the claw. Once the nail head is spaced from the board, a user positions the nail shaft in the gap between the claw fingers and positions the head of the hammer against the board. The user then pivots the hammer in a plane extending through the axis of the gap in the claw and in a direction away from the claw. That is, the user pushes, or pulls, depending upon his position relative to the hammer, on the hammer handle in a direction away from the claw. As the head of the hammer pivots against the board, the claw engages the nail head. The claw and the nail then move away from the substrate while traveling through an arc. If a nail is generally short, for example, about an inch or two in length, such a motion will completely remove the nail from the board or remove enough of the nail so that the user may simply pull the nail free. That is, when the nail is inserted into the board, the nail creates a generally straight hole and is held in place by friction. When a nail is relatively short, the arcuate motion of the claw pulls the nail generally longitudinally until the friction with the board is reduced and the nail is pulled free.

There are, however, longer nails. Nails with an extended length may still be substantially disposed within the substrate and held by friction after the hammer has been pivoted. Also, where a long nail is made from a very rigid material, the nail may not bend as it is being pulled from the generally straight nail hole. In this instance, the head of the nail may be lifted above the claw causing the claw to simply slide over the shaft of the nail. From a mechanical perspective, the problem with this situation is that the pivot point of the hammer, as well as the path of travel of the claw, is below the head of the nail. Thus, one very old solution was to place a board, or other object, below the head of the hammer thereby placing the pivot point and the head of the nail in about the same plane. In this configuration, the pivoting motion of the hammer again caused the claw to engage and lift the nail head.

Rather than having a user find or carry an extra board, prior improvements incorporated a plunger into the tool head. That is, as shown in U.S. Pat. No. 540,697, a spring loaded plunger was disposed in the head of a hammer. The plunger was structured to extend along the axis of the hammer handle and was held in place by a release lever. The release lever included a lateral latch that engaged notches on the plunger. When the user actuated the release lever, the latch would disengage the notch and the spring would cause the plunger to extend from the top of the hammer head. The plunger positioned the hammer head a distance from the substrate, or board, and generally in the same plane as the head of the nail. The user could then pivot the hammer about the tip of the plunger. Disadvantages of this configuration included the cost and complexity of the release lever. Further, the release lever could accidentally release when the hammer was used to impact another object. That is, the release lever operated in a plane corresponding to the plane of the hammer head. Thus, when the hammer head impacted an object, e.g. a nail, the release lever could accidentally be actuated causing the plunger to extend.

Other hammers with plungers attempted to overcome some of these disadvantages by providing plungers that were held in place by threads, see e.g., U.S. Pat. Nos. 4,998,996 and 5,441,236. That is, the hammer head and/or handle included a threaded bearing and the plunger had a threaded outer surface. The plunger extended through the handle and an actuating knob was located at the bottom of the handle. By turning the knob, the plunger extended from the top of the hammer head. These designs, however, were difficult, or at least slow, to operate and required that the plunger extend through the entire handle. Such a design could not typically be used with a hammer having a unitary metal head and neck as the neck on such hammers were generally too thin to allow for the plunger.

Another design for a plunger included an inverted U-shaped cap disposed over the hammer head and coupled to the plunger, and, a tension spring drawing the plunger to a position within the hammer. See, U.S. Pat. Nos. 2,589,046 and 2,589,047. In this configuration, the user pulled the plunger into the extended position and rotated the U-shaped cap so that the tips of the cap engaged the hammer head. While this design could not be accidentally actuated, there were other problems. For example, the hammer head had to have pockets cut therein to accommodate the U-shaped cap as well as having a socket for the plunger cut into the handle. Because hammer heads are typically made from a hard metal, the cutting of the pockets is both time consuming and difficult.

There is, therefore, a need for a hand tool having a claw with a plunger that resists accidental actuation and which is easy to assemble.

There is a further need for a hand tool having a claw with a plunger that may be used with a metal hammer head having a unitary metal neck.

SUMMARY OF THE INVENTION

These needs, and others, are met by at least one embodiment of this invention which provides for a hand tool having an elongated plunger that is rotatably and movably disposed in a socket. That is, the plunger can be rotated between a first orientation and a second orientation as well as being moved between a first, withdrawn position and a second, extended position. The plunger also has an upper notch and a lower notch on a front side and at least one generally flat lateral side. A fixed latch member extends across a portion of the socket and defines a narrow passage within the socket. The hand tool, preferably, includes a compression spring biasing the plunger toward the extended position. In this configuration, the plunger operates as follows.

Initially the plunger is in the first, withdrawn position and the first orientation. In this position/orientation, the plunger upper notch engages the latch member. That is, in this orientation the plunger is too wide to pass through the passage defined by the latch member and, as such, the latch member must be disposed in the notch. To move the plunger into the second, extended position, the user rotates the plunger so that the at least one generally flat lateral side is adjacent to the latch member. This is the second orientation and in this orientation the plunger may pass through the passage defined by the latch member. As such, the bias of the spring will cause the plunger to move longitudinally into the second, extended position. The plunger is then rotated back to the first orientation wherein the lower notch engages the latch member. More preferably, the spring is fixed to both the tool head and the bottom of the plunger. In this configuration, the torsion of the spring will bias the plunger to the first orientation.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, the word "unitary" means a component is created as a single piece or unit. That is, a component that includes pieces that are created separately and then joined together as a unit is not a "unitary" component or body.

As used herein, "coupled" means a link between two or more elements, whether direct or indirect, so long as a link occurs. Further, different portions of a unitary body are also "coupled" together.

As used herein, "directly coupled" means that two elements are directly in contact with each other.

As used herein, "fixedly coupled" means that two separate elements are coupled so as to move as one.

Figure 1:
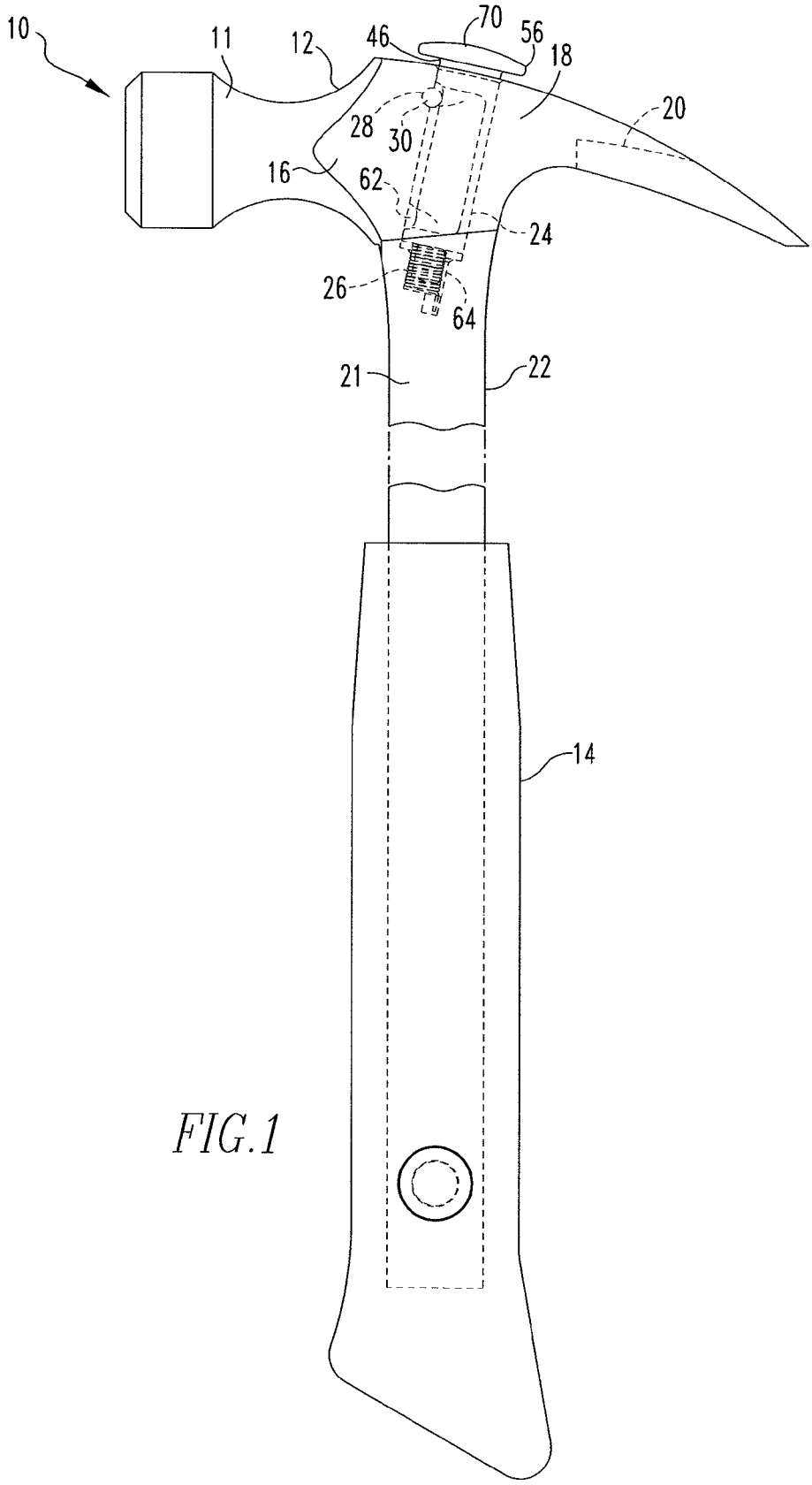
FIG. 1 is an isometric cutaway view of the tool with the plunger in the first position and the first orientation.
Figure 2:
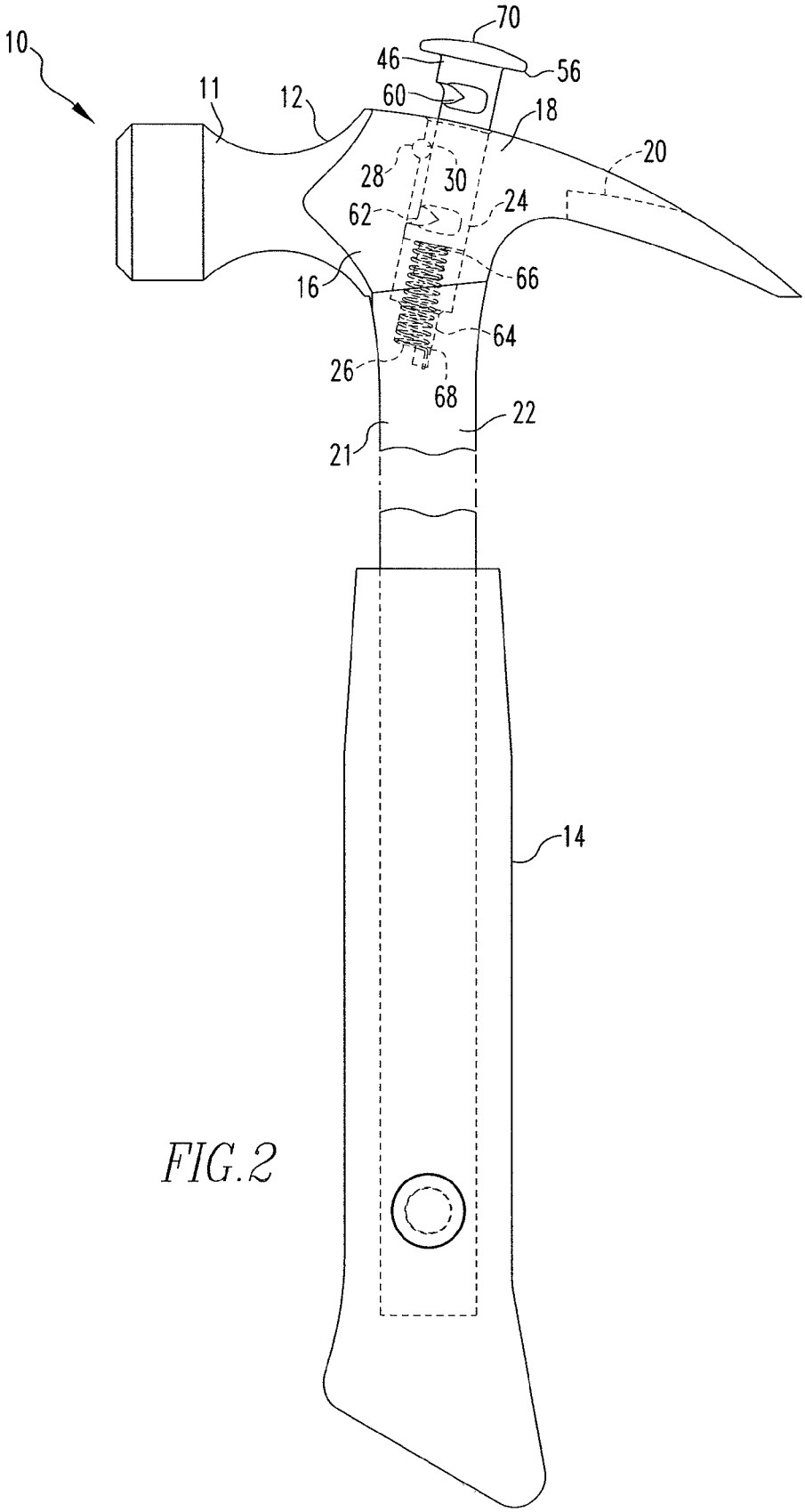
FIG. 2 is an isometric cutaway view of the tool with the plunger in a transitional position and the second orientation.
Figure 3:
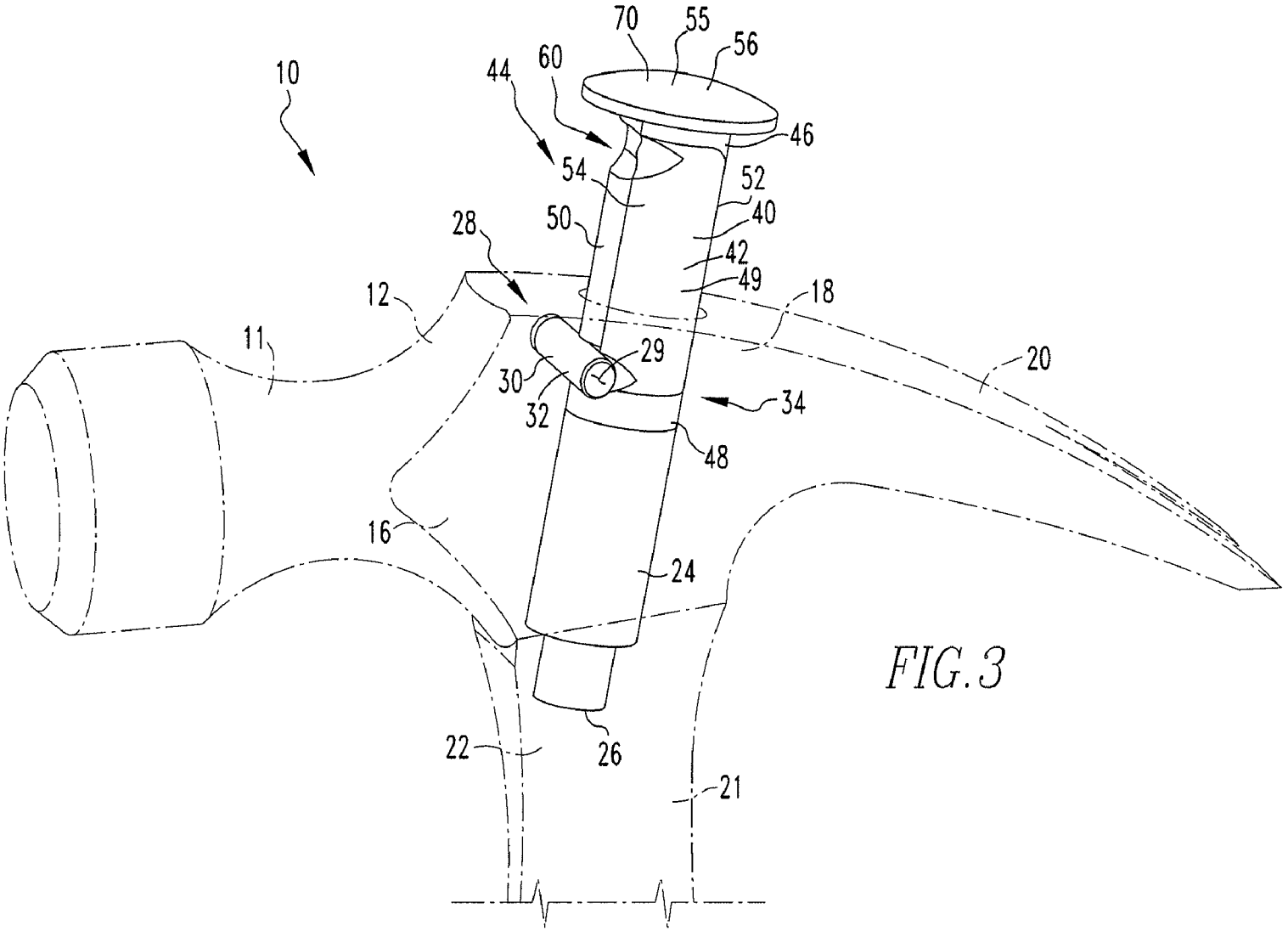
FIG. 3 is an isometric cutaway view of the tool with the plunger in the second position and the first orientation.

As shown in FIGS. 1-3, a hand tool 10, which is shown as a hammer 11, includes a tool head 12 which is coupled to a handle 14. The tool head 12 is preferably a unitary body 16 having an axial portion 18, which typically extends along the axis of the handle 14, a claw 20, which typically extends perpendicular the axis of the handle 14, and a neck 22, which also typically extends along the axis of the handle 14. The tool head 12 defines an elongated socket 24 having a bottom 26. Preferably, the socket 24 is disposed in the axial portion 18. The socket 24 has a generally circular cross-section. The tool head 12 also defines a lateral bore 28 extending from an opening 29 on the outer surface of the tool head 12 laterally across the socket 24. That is, the lateral bore 28 extends generally perpendicular to the longitudinal axis of the socket 24. In this configuration, the lateral bore 28 defines a chord across the socket 24. Preferably, the neck 22 is contoured to be wide adjacent to the axial portion 18 and has a thinner medial portion 21. The neck medial portion 21 has a cross-sectional area of between about 0.15 and 0.25 in.$^2$ and more preferably about 0.20 in.$^2$ The socket 24 has a cross-sectional area of between about 0.60 and 0.70 in.$^2$ and more preferably about 0.65 in.$^2$ As such, the socket 24 does not extend into, or through, the neck medial portion 21.

The hand tool 10 further includes a latch member 30 that is disposed within the lateral bore 28 and fixed to the tool head 12. The latch member 30 is part of a locking assembly 44 described in more detail below. The latch member 30 is, preferably a generally cylindrical rod 32. When the latch member 30 is disposed in the lateral bore 28 a passage 34 is created within the socket 24. The passage 34 has a reduced cross-sectional area relative to the socket 24. Further, because the latch member 30 extends across the socket 24 as a chord, the passage 34 has a cross-sectional shape similar to a capital letter "D."

The hand tool 10 further includes a plunger assembly 40 having an elongated body 42 and a locking assembly 44. The plunger assembly body 42 has a top end 46, a bottom end 48, a medial portion 49, a front side 50, a back side 52, and at least one generally flat lateral side 54 extending over substantially all of the plunger assembly body 42. The plunger assembly body front side 50 and back side 52 are, preferably, arcuate and sized to fit within, but generally correspond to the shape of, the socket 24. That is, the plunger assembly body 42 is sized to be rotatably disposed within the socket 24 but not so small as to wobble within the socket 24. Thus, with one generally flat lateral side 54, the plunger assembly body 42 has a cross-sectional shape similar to a capital letter "D" wherein the plunger assembly body front side 50 and back side 52 are arcuate. In this configuration, the plunger assembly body medial portion 49 has a width between the front side 50 and the back side 52 that is greater than the width of the passage 34. Further, the plunger assembly body medial portion 49 has a width between the at least one generally flat lateral side 54 and a side opposite the at least one generally flat lateral side 54 that is less than the width of the passage 34. The plunger assembly body top end 46 may also include a cap 55 which is a disk 56 disposed in a plane generally perpendicular to the longitudinal axis of the plunger assembly body 42. The disk 56 is larger than the socket 24 and provides a pivot surface 70 as described below. The plunger assembly body bottom end 48 is, preferably, circular and has a greater cross-sectional area than the passage 34. That is, the at least one generally flat lateral side 54 does not extend over the plunger assembly body bottom end 48.

The locking assembly 44 includes the latch member 30 described above as well as an upper, first notch 60, a lower, second notch 62 and, preferably, a spring 64. The first notch 60 and second notch 62 each extend laterally across the plunger assembly body front side 50. The first notch 60 is disposed adjacent to the plunger assembly body top end 46. The second notch 62 is disposed adjacent to the plunger assembly body bottom end 48. The first notch 60 and second notch 62 each are sized to accommodate the latch member 30. That is, the latch member 30 may fit within the first notch 60 and second notch 62. The spring 64 is, preferably, a compression spring 64 having a first end 66 and a second end 68. The spring 64 is disposed between the socket bottom 26 and the plunger assembly body bottom end 48. In a more preferred embodiment, the spring 64 is fixed to the plunger assembly body bottom end 48. Further, the spring 64 is also prevented from rotating in the socket 24. For example, the socket 24 may include and extended pit and the spring 24 may have a tab that extends into the pit. However, in a preferred embodiment, the spring 64 is fixed to the socket bottom 26 by any known method. When the spring 64 is fixed to both the socket bottom 26 and the plunger assembly body bottom end 48 the torsion of the spring 64 will bias the plunger assembly body 42 to a specific orientation as described below.

The hand tool 10 is assembled as follows. The spring second end 68 is fixed to the socket bottom 26. The spring first end 66 is then fixed the plunger assembly body bottom end 48. As the spring first end 66 is being fixed to the plunger assembly body bottom end 48, the plunger assembly body 42 is oriented so that the plunger assembly body front side 50 is adjacent to the lateral bore 28. As noted above, the torsion of the spring 64 will bias the plunger assembly body 42 to this "first orientation." The plunger assembly body 42 is then partially inserted into the socket 24 and the spring 64 is compressed. It is noted that the plunger assembly body bottom end 48 which has a greater cross-sectional area than the passage 34 may pass through the space that will become the passage 34 due to the fact that the latch member 30 has not been installed and the passage 34 is not yet defined. The plunger assembly body 42 is then rotated until the at least one generally flat lateral side 54 is disposed adjacent to, or facing, the lateral bore 28. In this orientation, the plunger assembly body 42 does not extend into the space defined by the lateral bore 28. It is noted that when the plunger assembly body 42 is so rotated, the plunger assembly body 42 is in the "second orientation." The latch member 30 is then inserted into the lateral bore 28 and fixed in place. The plunger assembly body 42 is then substantially inserted into the socket 24 until the first notch 60 is aligned with the latch member 30. The plunger assembly body 42 is then returned to the first orientation and the latch member 30 is disposed with the first notch 60. Further, in this position, the generally flat disk 56 is disposed immediately adjacent to the top surface of the tool head 12.

In this configuration, the plunger assembly body 42 is rotatably and movably disposed in the socket 24. The plunger assembly body 42 is structured to move between a first, withdrawn position, wherein the plunger assembly body 42 is substantially disposed within the socket 24, and a second, extended position, wherein the plunger assembly body 42 extends from the socket 24. As noted above, the plunger assembly body 42 is also structured to rotate between a first orientation, wherein the plunger assembly body front side 50 is disposed adjacent to the fixed latch member 30, and a second orientation, wherein the plunger assembly body 42 at least one generally flat lateral side 54 is disposed adjacent to the fixed latch member 30. When the plunger assembly body 42 is in the first position and the first orientation, the first notch 60 engages the fixed latch member 30. To extend the plunger assembly body 42, the user rotates the plunger assembly body 42 into the second orientation. In the second orientation, the latch member 30 is not disposed in the first notch 60 and the spring 64 will bias the plunger assembly body 42 to the second position. That is, because the plunger assembly body medial portion 49 has a width between the at least one generally flat lateral side 54 and a side opposite the at least one generally flat lateral side 54 that is less than the width of the passage 34, the plunger assembly body 42 may slide through the passage 34. When the plunger assembly body 42 is in the second, extended position, the plunger assembly body 42 is returned to the first orientation by the torsion of the spring 64 and the second notch 62 engages the latch member 30. In this configuration the user may position the pivot surface 70 against a substrate thereby positioning the claw 20 a distance from the substrate. The user may then pivot the hand tool 10 about the pivot surface 70 to engage in a prying action. The user may reposition the plunger assembly body 42 in the first position and first orientation by reversing the steps set forth above.

While specific embodiments of the invention have been described in detail, it will be appreciated by those skilled in the art that various modifications and alternatives to those details could be developed in light of the overall teachings of the disclosure. For example, the at least one generally flat lateral side 54 may include two generally flat lateral sides 54 so that the plunger assembly body 42 could be rotated in either direction in order to fit through the passage 34. Accordingly, the particular arrangements disclosed are meant to be illustrative only and not limiting as to the scope of invention which is to be given the full breadth of the claims appended and any and all equivalents thereof.

What is claimed is:

1. A method of assembling a hand tool comprising the steps of:

a) providing a tool head having a claw, said tool head defining an elongated socket having a circular cross-sectional area and a bottom, said socket having a lateral bore extending to an opening on the outer surface of said tool head, said lateral bore defining a chord across said socket;

b) providing a plunger assembly having an elongated body with a top end, a bottom end, said plunger assembly body having a first lateral notch adjacent said top end, and a second lateral notch adjacent said bottom end, said plunger assembly body bottom end having a cross-sectional area slightly smaller than said socket;

c) providing an elongated latch member sized to be disposed in said lateral bore;

d) inserting said plunger assembly body into said socket; and e) inserting and fixing said latch member within said lateral bore, said latch member defining a passage in said socket.

2. The method of claim 1 wherein said plunger assembly body has a front side, an arcuate back side and at least one generally flat lateral side, said first notch and said second notch disposed on said front side and comprising the further steps of:

a) providing a compressing spring with a first end and a second end;

b) fixing said spring first end to said plunger assembly body bottom end; and c) fixing said spring second end said socket bottom.

* * * * *

UNITED STATES PATENT AND TRADEMARK OFFICE

CERTIFICATE OF CORRECTION

PATENT NO. : 7,979,971 B2
APPLICATION NO. : 12/754034
DATED : July 19, 2011
INVENTOR(S) : Mark P. Noah et al.

It is certified that error appears in the above-identified patent and that said Letters Patent is hereby corrected as shown below:

Column 1, line 62, "U.S. Pat. No. 540,697" should read --U.S. Pat. No. 540,967--.
Column 4, line 61, "and extended" should read --an extended--.
Column 4, line 65, "end 48 the" should read --end 48, the--.
Column 5, line 3, "fixed the" should read --fixed to the--.
Column 6, line 54, "end said" should read --end to said--.

Signed and Sealed this
Twentieth Day of December, 2011

David J. Kappos

David J. Kappos
*Director of the United States Patent and Trademark Office*